US007544086B1

(12) United States Patent
Wells

(10) Patent No.: US 7,544,086 B1
(45) Date of Patent: Jun. 9, 2009

(54) TORQUE INDICATIONS FOR COAXIAL CONNECTORS

(75) Inventor: Chad T. Wells, Highlands Ranch, CO (US)

(73) Assignee: Evolution Broadband, LLC, Centennial, CO (US)

( * ) Notice: Subject to any disclaimer, the term of this patent is extended or adjusted under 35 U.S.C. 154(b) by 0 days.

(21) Appl. No.: 12/044,671

(22) Filed: Mar. 7, 2008

(51) Int. Cl.
*H01R 3/00* (2006.01)

(52) U.S. Cl. ..... 439/489

(58) Field of Classification Search ..... 439/489, 439/491, 322, 320, 321
See application file for complete search history.

(56) References Cited

U.S. PATENT DOCUMENTS 2,294,432 A * 9/1942 Weidner ..... 439/322
5,232,377 A * 8/1993 Leibfried, Jr. ..... 439/320
7,497,723 B2 * 3/2009 Brassell et al. ..... 439/489

* cited by examiner

*Primary Examiner*—Phuong K Dinh
(74) *Attorney, Agent, or Firm*—John R. Ley; Leon S. Erikson

(57) ABSTRACT

A male coaxial connector is rotatably tightened onto a female coaxial connector to a recommended torque specification by visually observing relative positions of indicators of both connectors, beginning at a pre-torque relationship and continuing tightening with a wrench.

20 Claims, 5 Drawing Sheets

TORQUE INDICATIONS FOR COAXIAL CONNECTORS

This invention relates to coaxial connectors of the type which are typically used on and connected to coaxial cable termination adapters, and more particularly to a new and improved coaxial connector and method of connecting a coaxial connector which facilitate achieving a desired level of torque to assure a proper connection without using a torque wrench or other torque measurement device.

BACKGROUND OF THE INVENTION

Coaxial cable related services ("cable services"), such as television, Internet, and digital voice, are provided to more than half of U.S. households. Households receiving cable services are connected to a service provider through a coaxial cable network ("cable network") that includes many individual coaxial cables which are connected to various devices such as hubs, amplifiers, switches, adapters, junctions, couplings, encoders, decoders, cable modems, set top boxes, televisions and computers, as well as other well-known devices (all of which are collectively referred to herein as "terminal adapters"). Coaxial cable is a reliable medium for conducting high frequency (HF) signals between and to the terminal adapters with a high level of integrity in the presence of adverse external influences that would otherwise deteriorate the HF signals or render them unusable.

The coaxial cable connections ("coaxial connections") between terminal adapters and between the coaxial cables themselves within a cable network are a frequent cause of service outages for cable network customers. Fixing a faulty coaxial connection usually involves sending a technician to discover and repair the problem. A significant cost is incurred by the service provider in sending technicians to fix such connections. It is estimated that approximately 50% of service calls made by technicians result from simple problems of inadequate or improper coaxial connections. Such costs are reflected in higher costs to the service provider and to the customer.

A common cause of faulty coaxial connections results when the two parts of a coaxial connector are not adequately mated together to form a coaxial connection of high integrity for conducting the HF signals. In many cases, a faulty coaxial connection results from the two mating connector parts not being tightened together to a recommended torque specification. Both over-tightening and under-tightening the two parts of a coaxial connector adversely affects the integrity of the HF signal passing through the coaxial connection. Under-tightening the connector parts often results in a loose connection which can cause intermittent changes in conductivity, which can have the effect of intermittently terminating the HF signals or of introducing undesired and unexpected impedance into the signal path which degrades the quality of the HF signal. Over-tightening the connector parts can distort the shape of the electrical contact elements, which can also result in intermittent conductivity and changes in the quality of the HF signal. Both under-tightening and over-tightening the connector parts of a coaxial connection which is exposed to the outside environment may allow moisture to enter into the connector and degrade the electrical contact elements or introduce circuit paths and impedances that create an adverse effect on the quality of the HF signal. Indeed, outside coaxial connections may use different features of the two mating connector parts to prevent moisture intrusion, and because of the different characteristics of the two mating connector parts, may require them to be tightened to different amounts of torque compared to the different amounts of torque used to tighten the mating connector parts on an interior coaxial connection.

Tightening the mating parts of a coaxial connection to the recommended torque specification has required the use of a torque wrench. The different types and sizes of coaxial connectors have different recommended torque specifications, which the technician must remember or must look up. Looking up the preferred torque settings of different coaxial connector types is time consuming. Carrying and using an extra tool, the torque wrench, also requires additional effort. The practical reality is that determining the appropriate amount of torque and then using a torque wrench to connect the parts at that appropriate amount of torque, requires extra effort that is sometimes not expended by technicians. Instead, the technicians may simply use a regular wrench and apply an amount of torque on the coaxial connector which the technician subjectively feels or judges to be sufficient, apart from the specified desired amount of torque and apart from actually measuring the amount of torque applied.

SUMMARY OF THE INVENTION

This invention facilitates tightening the mating connector parts of a coaxial connection to a recommended torque specification without the use of a torque wrench and without the necessity to memorize or look up specific torque specifications. Use of the present invention reduces the frequency of service outages and degraded service in a cable network by preventing or reducing under-tightening and over-tightening of the mating parts of coaxial connections. Reducing the number of outages of service and the number of instances of degraded service enhances the perception of the quality of service, thereby improving customer satisfaction, while simultaneously reducing the costs and the number of instances of technician-performed repair service.

In accordance with these and other features, one aspect of the invention involves a coaxial connector for connecting a coaxial cable. The coaxial connector comprises a first coaxial connector part with a threaded post, and a second coaxial connector part with a nut having a threaded interior which mates with the threads of the post. A first indicator is attached to the nut to move in conjunction with the rotation of the nut relative to the post while connecting the first and second connector parts. A second indicator is associated with one of the first or second coaxial connector parts to provide a stationary reference by which to measure the amount of rotation of the nut. A predetermined amount of relative rotation of the first indicator relative to the second indicator beginning at a predetermined pre-torque relationship correlates to a predetermined final amount of desired torque for tightening the nut onto the post and connecting the coaxial connector parts with a desired amount of torque.

A further aspect of the invention involves a method of tightening a two-part, rotationally-connectable, coaxial connector to a recommended torque specification without measuring torque. The method involves using a first part of the coaxial connector which has a rotatable internally threaded nut and at least one first indication on the nut, and using a second part of the coaxial connector which has a stationary externally threaded post and at least one second indication relative to the post. The nut is threaded onto the post by rotating the nut relative to the post. The nut is threaded onto the post until a predetermined amount of torque between the nut and the post is established. The predetermined amount of torque is established by using the movement of the first indicator relative to the second indicator.

In all preferable aspects of the invention, the number of movement transitions between the first and second indicators is correlated to establish the predetermined amount of torque. The number of transitions establishes the predetermined amount of torque without the use of a torque wrench or other torque measuring device. Information is associated with at least one of the first and second connector parts which correlates the amount of relative movement of the first and second indicators to establish the predetermined torque to connect the first and second connector parts.

Other aspects of the invention, and a more complete appreciation of the present invention, as well as the manner in which the present invention achieves the above and other improvements, can be obtained by reference to the following detailed description of a presently preferred embodiment taken in connection with the accompanying drawings, which are briefly summarized below, and by reference to the appended claims.

DETAILED DESCRIPTION

Figure 1:
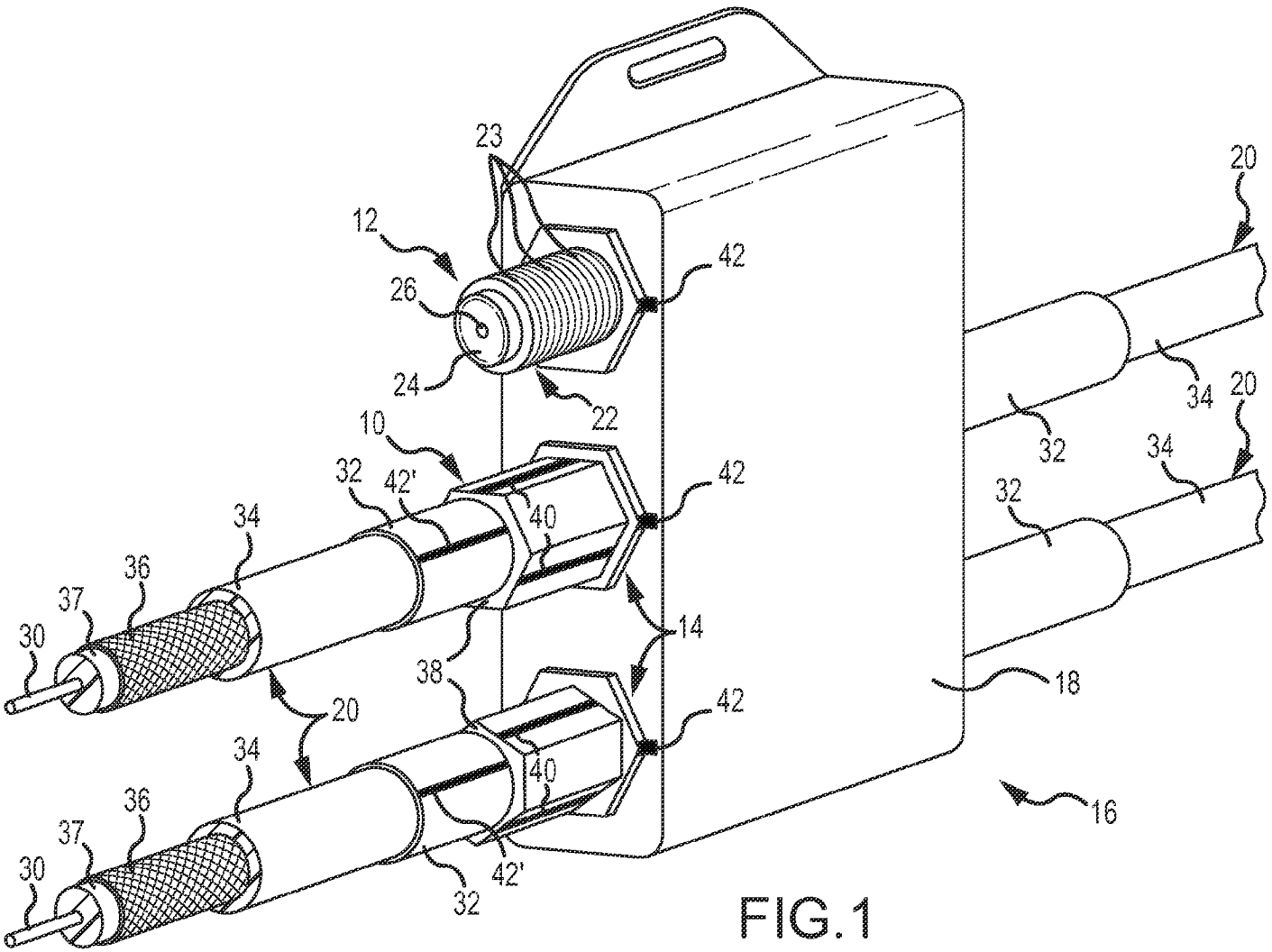
FIG. 1 is a generalized perspective view of a coaxial cable terminal adapter to which a coaxial cable is connected by the use of a two-part coaxial cable connector which incorporates aspects of the present invention.

The present invention relates to connecting a male part 10 to a mating female part 12 of a coaxial connector 14, as shown in FIG. 1, to achieve a desired amount of torque at a threaded-together connection of the two parts 10 and 12 to ensure an adequate and intended connection of good integrity that minimizes signal conductivity problems. One of the parts 10 and 12 of the coaxial connector 14, typically the female part 12, is connected to a terminal adapter 16. The terminal adapter 16 usually includes an exterior metal housing 18 within which electrical components (not shown) achieve desired functionality with respect to conducting high frequency (HF) signals through coaxial cables 20. Examples of terminal adapters 16 which accomplish different HF signal conducting functions are hubs, amplifiers, switches, adapters, junctions, couplings, encoders, decoders, cable modems, set top boxes, televisions and computers, among other things. The terminal adapter 16 typically includes multiple coaxial connectors 14, by which to interconnect multiple coaxial cables 20.

Figure 2:
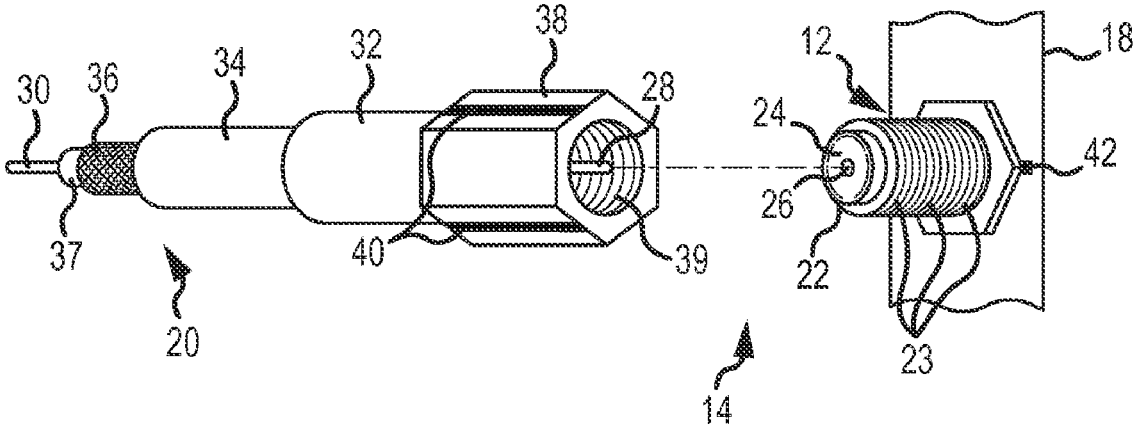
FIG. 2 is an exploded perspective view of male and female parts of the coaxial connector shown in FIG. 1, shown in a disconnected relationship.
Figure 3:
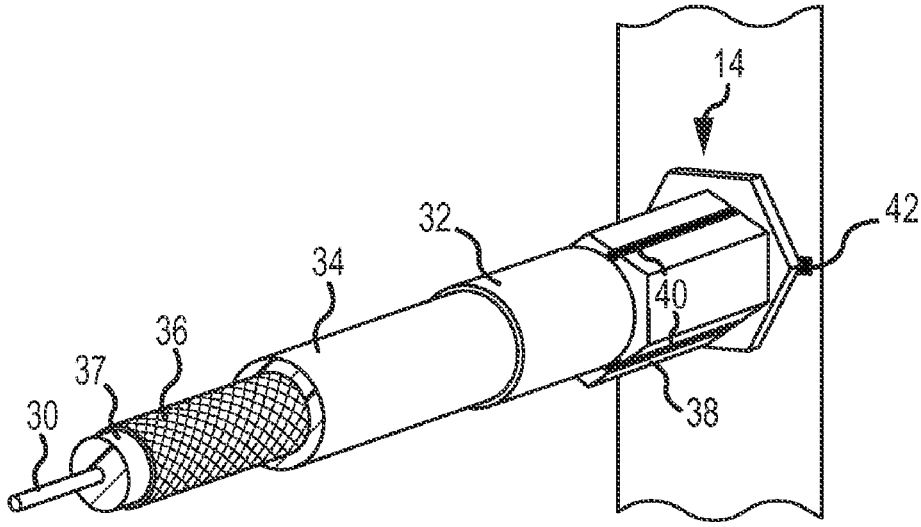
FIG. 3 is a perspective view of the parts of the coaxial connector shown in FIG. 2, shown in a connected-together relationship.

Details of each coaxial connector 14 are shown in FIGS. 2 and 3. The female part 12 is attached to the housing 18 of the terminal adapter 16 (FIG. 1) in a conventional manner, usually with a locknut (not shown) on the inside of the housing 18. An annular metal post 22 projects outward and has threads 23 formed on its exterior. The male part 10 is threaded onto the post 22, to connect the parts 10 and 12 together. The annular center of the post 22 is hollow, and an electrical insulator 24 is located coaxially within the hollow interior of the post 22. An electrically conductive receptacle 26 is located coaxially within the center of the electrical insulator 24 and coaxially with respect to the post 22 and threads 23. The receptacle 26 is electrically connected by conductors (not shown) to the components within the interior of the terminal adapter 16.

The receptacle 26 receives a center pin 28 of the male connector part 10, when the parts 10 and 12 are connected together. The center pin 28 is electrically connected to, or is formed by a terminal end portion, of a center conductor 30 of the coaxial cable 20. The center conductor 30 conducts the HF signal through the coaxial cable 20. The HF signal is conducted from the center pin 28 which is inserted into the receptacle 26 when the coaxial cable connector parts 10 and 12 are connected together, thereby transferring the HF signal from the conductor 30 of the coaxial cable 20 through the coaxial connector 14 into the electrical components within the housing 18 of the terminal adapter 16.

The male connector 10 comprises a body 32 which fits over a terminal end of the coaxial cable 20. The coaxial cable 20 includes an exterior layer 34 of electrical insulation which completely encloses an interior electrically conducting shielding layer 36, typically formed by foil or braided fine electrical conductors. The shielding layer 36 is connected to ground or a common electrical reference, and thereby shields the HF signals conducted on the center conductor 30 from external deleterious influences, such as noise and static. Connecting the shielding layer 36 to electrical reference also establishes a known impedance between the center conductor 30 and a reference potential through an annular layer electrical insulation 37 which surrounds the center conductor 30 and is located interiorly of the shielding layer 36. Establishing a known electrical impedance between the center conductor 30 and reference potential assures that the HF signal can be conducted through the coaxial cable with reliable and predictable characteristics.

The body 32 is mechanically and electrically connected to the shielding and exterior layers 36 and 34, typically either by crimping or compression, both of which are well-known. Both crimping and compressing involve pressing the body 32 against an end of a coaxial cable 20 after a portion of the electrical insulation layer 34 adjacent to the end is removed or after some of the shielding layer 36 is folded over on top of the electrical insulation layer 34, as is typical. The body 32 is then either crimped or slightly deformed in tight frictional contact with the exterior layers 34 and 36 or a conventional compression ring (not shown) is wedged annularly between the body 32 and the exterior layer 34 to secure the body 32 to the coaxial cable 20 in contact with the shielding layer 36. A connection nut 38 is rotatably mounted on the end of the body 32 adjacent to the center pin 28. A conventional flange or other swivel (neither shown) rotatably retains the nut 38 to the stationary body 32, thereby allowing the nut 38 to rotate around an axis of the body which is coaxial with the center conductor 30 and the center pin 28. The connection nut 38 has a coaxial open annular interior which is formed with internal threads 39.

To connect the parts 10 and 12, the internal threads 39 of the connection nut 38 are threaded over the exterior threads 23 of the post 22. It is this threaded connection between the post 22 and the nut 38 which should be torqued to a predetermined amount to ensure an adequate electrical connection between the parts 10 and 12, thereby ensuring that the center pin 28 is properly received within the receptacle 26 and that the terminal ends of the insulator 24 and the end of electrical insulation layer 34 abuts one another without deformation and without creating an intermittent or continuous open-circuit or short-circuit relationship of the center pin 28 or the receptacle 26 with the post 22 or the nut 38 or the body 32. The nut 38 has a typical hexagonal exterior flat surface configuration which allows a wrench to contact the hexagonally configured flat surfaces and apply torque to the nut 38 to tighten it onto the post 22.

Indications 40 are formed on the nut 38 at a plurality of equidistant locations around its outer surface and circumference. Indications 42 are also formed on the female part 12, or on the housing 18 adjacent to the female part 12, at a plurality of equidistant circumferential locations around the outer surface of the post 22. The indications 40 and 42 are used to establish the amount of relative rotation of the nut 38 relative to the post 22 to achieve the proper and desired amount of torque when connecting the coaxial connector parts 10 and 12 to obtain and ensure an electrical connection of high integrity.

The indications 40 and 42 can be engraved into the connector parts 10 and 12, molded as a part of the connector parts 10 and 12, or otherwise printed or marked on the connector parts 10 and 12. As an alternative to placing the indications 42 on the female part 12, they a may also be placed on the housing 18 of the terminal adapter 16, or could also be placed on a ring or placard which surrounds the connection of the part 12 into the housing. As a further alternative, indications 42' could be placed on the body 32, as shown only in FIG. 1, because the body 32 is stationary while the nut 38 is tightened. In any event, the indications 40 are associated with the relative position of the nut 38, and the indications 42 are associated with a multiplicity of relative stationary circumferential positions around the post 22.

The amount of movement of the indications 40 and 42 relative to one another establishes the desired amount of torque by tightening the nut 38 onto the post 22. The movement of the indications 40 relative to the indications 42 establish the amount of torque created. The amount of torque established by the connection of the parts 10 and 12 is established by the relative movement of the indications 40 and 42 after the parts 10 and 12 come into an initial firm contact. The initial firm contact, referred to as a pre-torque relationship, usually occurs when the nut 38 has been threaded onto the post 22 in a finger tight position. After achieving the finger tight, pre-torque relationship, a wrench is placed over the nut 38 to rotate it a further amount established by the relative position of the indications 40 and 42, to achieve the final relative rotational position which establishes the desired amount of torque, referred to herein as the post-torque relationship.

Figure 4:
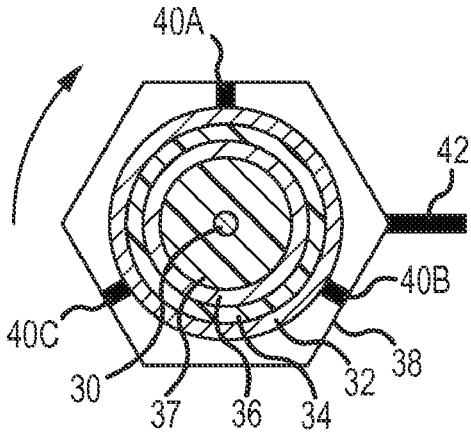
FIG. 4 is an end cross sectional view of the parts of the coaxial connector shown in FIG. 3, showing a pre-torque relationship.
Figure 5:
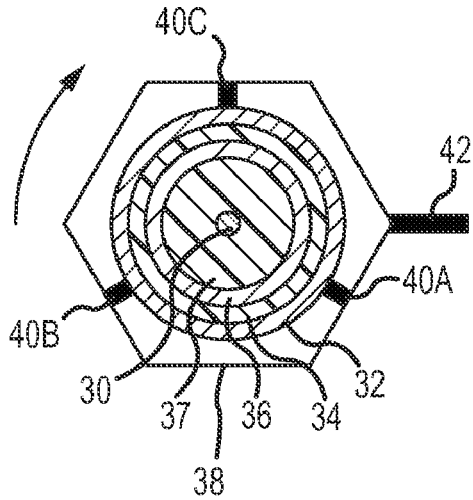
FIG. 5 is an end cross sectional view of the parts of the coaxial connector shown in FIGS. 3 and 4, illustrating a post-torque relationship.

Establishing the finger-tight, pre-torque relationship and then continuing to rotate the nut 38 to the final, post-torque relationship is illustrated in FIGS. 4 and 5.

After the nut 38 has been tightened onto the post 22 to the finger-tight, pre-torque relationship, shown in FIG. 4, the technician takes note of the relative position of the indications 40 and 42. For example, FIG. 4 shows a single indication 42 associated with the female part 12 which is located between indications 40A and 40B associated with the nut 38 of the male part 10. The indication 40A is rotationally (in a clockwise direction shown) in advance of the indication 42, while the indication 40B is shown clockwise rotationally past the indication 42. A conventional wrench is placed in contact with the nut 38 and the nut 38 is tightened to move the indication 40A rotationally past indication 42, as shown in FIG. 5, thereby achieving the post-torque relationship. Tightening the nut 38 continues until the desired number of indications 40A, 40B and 40C have rotated past the indication 42. The final desired torque level in connecting the parts 10 and 12 is established by the relative movement of the indications 40 and 42 relative to one another.

Figure 6:
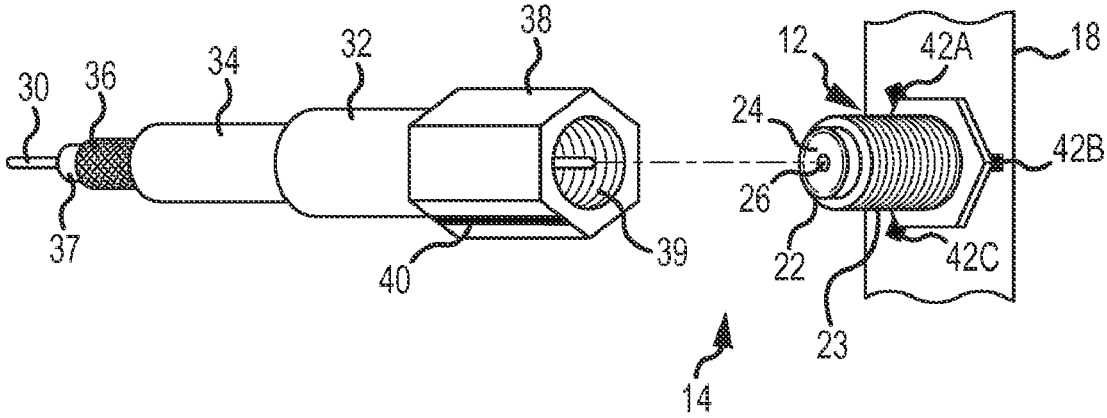
FIG. 6 is an exploded perspective view of disconnected male and female parts of the coaxial connector, similar to that view shown in FIG. 2, showing a different configuration of torque indications.
Figure 7:
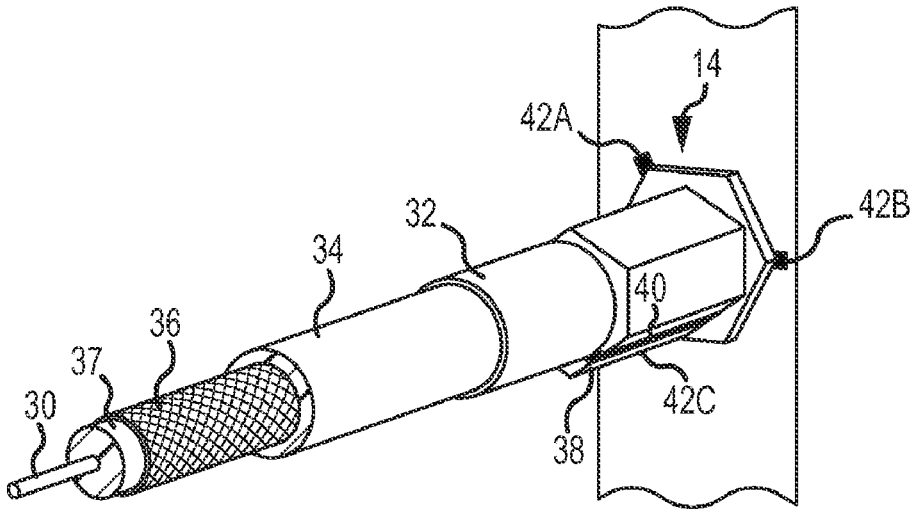
FIG. 7 is a perspective view of the parts of the coaxial cable shown in FIG. 6, shown in a connected-together relationship similar to the view shown in FIG. 3, showing a different configuration of torque indications.
Figure 8:
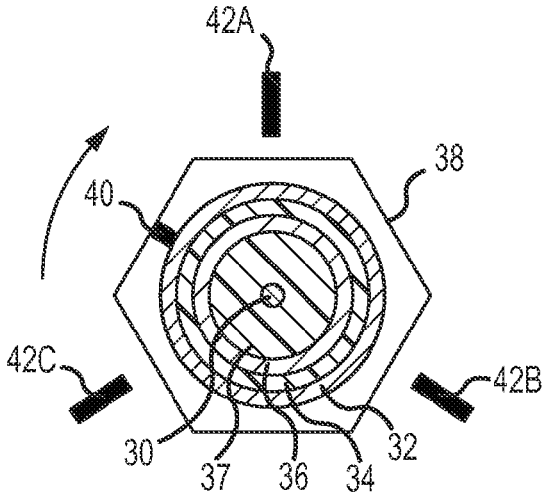
FIGS. 8 and 9 are partial cross sectional views of the coaxial connector shown in FIG. 7 in pre-torqued and post-torqued relationships comparable to those shown in FIGS. 4 and 5, respectively.
Figure 9:
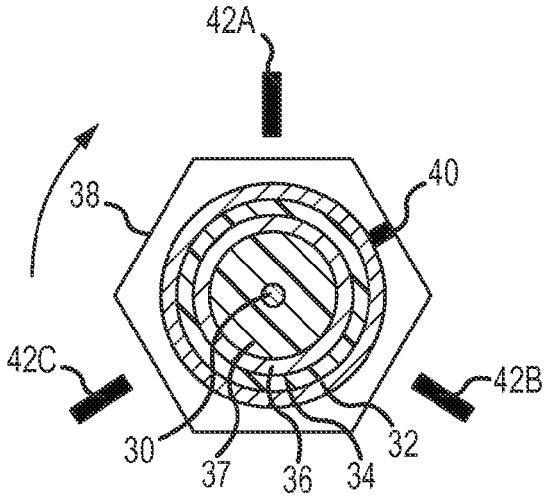

Similarly, the present invention also involves the opposite relationship of that shown in FIGS. 4 and 5. As shown in FIGS. 6 and 7, a single indication 40 is formed on the nut 38, and multiple indications 42A-42C are formed on the female part 12 or on the housing 18, or otherwise associated with the female part 12. The nut 38 is tightened onto the post 22 to achieve the final recommended torque specification by first threading the nut 38 onto the post 22 until it is finger tight, thereby establishing the pre-torque relationship. The position of the indication 40 relative to the indications 42A, 42B and 42C is next noted. The indication 40 is shown midway between indications 42A and 42C in FIG. 8, which represents the pre-torque relationship. Next, a wrench is placed on the nut 38, and the nut 38 is further tightened until a desired relationship of the indication 40 and the indications 42A, 42B and 42C is achieved to establish the final post-torque relationship, as is indicated by the indication 40 occupying a position located midway between the pair of indications 42A and 42B, as shown in FIG. 9.

Although a single indication 42 is shown for illustrative purposes in FIGS. 4 and 5, and a single indication 40 is shown for illustrative purposes in FIGS. 6 and 7, a greater number of indications 42 in each case will allow more precision in determining the relative rotational position of the nut 38 to establish the desired amount of torque. In other words, multiple indications are preferably associated with both the nut 38 and the female part 12. The greater number of indications 40 associated achieve even further precision in the amount of torque applied as established by the relative rotation of the nut 38 from the pre-torque relationship to the post-torque relationship. The rotational intervals for the indications 40 associated with the male part 10 do not have to be the same rotational intervals for the indications 42 associated with the female part 12.

To achieve the desired level of torque, the number of indications 40 and 42 that move relative to one another is all that is used. The number of indications 40 and 42 that move relative to one another from the finger-tight, pre-torque relationship may even be printed or otherwise indicated on the connector parts, thereby eliminating any need for the technician to look up or memorize numbers or relationships.

Because the relative rotation of the nut 38 to the post 22 in the pre-torque relationship is important in establishing a starting point for determining the number of indications 40 and 42 that move relative to one another, the pre-torque relationship must be reliably established. In general terms, the pre-torque relationship is established by a finger-tight connection of the nut 38 on the post 22. In most cases, a finger-tight connection will result in approximately the same initial pre-torque relationship despite differences in strength of the technician making that finger-tight connection, particularly if the rotational intervals between the indications 40 and 42 are moderately or coarsely spaced apart. In general, the nut 38 will usually not rotate a significant amount more by the use of very forceful finger pressure, compared to the rotational position achieved by moderate or average finger pressure. This occurs because the ends of the insulator 24 and the insulating body 32 (FIG. 2) contact one another relatively abruptly and firmly to require significantly more rotational torque to be applied to thread the nut 38 further on the post 22. Prior to the insulator 24 and the insulating body 32 contacting one another, the nut 38 rotates very freely on the post 22. Thus, this finger tight relationship is typically obtained on a very consistent basis, despite the strength of finger pressure applied.

By tightening a body of a male coaxial connector in this manner, a coaxial connection is formed and tightened to a recommended torque specification without the use of a torque wrench. Over tightening and under tightening of the coaxial connection is avoided thus improving the integrity of the HF signal conducted through the coaxial connector and thereby improving the quality and service level provided by the cable network, while reducing costs and outages associated with service problems resulting from under-tightening and over-tightening.

Use of the indications 40 and 42 to achieve a predetermined desired amount of torque for connecting the parts 10 and 12 of the coaxial cable 14 also achieves a substantial cost savings. The number of service calls or so-called "truck rolls," in which a technician is dispatched to investigate a service outage or problem and to repair a coaxial connection 42 should be minimized, because many of these service difficulties are created by coaxial connectors which have not been tightened to the desired amount of torque. Because truck rolls constitute a considerable amount of the cost of a service provider, minimizing truck rolls reduces costs.

The significance of these and other improvements and advantages will become apparent upon gaining a full appreciation of the ramifications and improvements of the present invention. Preferred embodiments of the invention and many of its improvements have been described with a degree of particularity. The detail of the description is of preferred examples of implementing the invention. The detail of the description is not necessarily intended to limit the scope of the invention. The scope of the invention is defined by the following claims.

What is claimed:

1. A coaxial connector for connecting a coaxial cable to a housing, comprising:

a first coaxial connector part comprising a nut having a threaded interior, the first coaxial connector part attached to the coaxial cable;

a second coaxial connector part comprising a post with a threaded exterior with which the nut of the first coaxial connector part mates, the second coaxial connector part attached stationarily to the housing;

at least one first indicator attached to the nut to move in conjunction with the nut when the nut is rotated relative to the second coaxial connector part while threading the interior threads of the nut onto the exterior threads of the post;

at least one second indicator associated with the second coaxial connector part and attached to provide a stationary reference at the housing by which to measure the amount of rotation of the nut relative to the second coaxial connector part; and wherein:

a predetermined amount of relative rotation of the first indicator relative to the second indicator from a predetermined pre-torque relationship correlates to a predetermined final amount of desired torque for tightening the nut onto the post to connect the first and second coaxial connector parts with a desired amount of torque.

2. A coaxial connector as defined in claim 1, wherein:

the nut rotates relative to the coaxial cable connected to the first connector part; and the second indicator is located stationarily relative to the coaxial cable to which the first coaxial cable part is connected.

3. A coaxial connector as defined in claim 1, further comprising:

a plurality of the first indicators located at rotational intervals associated with the nut.

4. A coaxial connector as defined in claim 3, wherein:

the plurality of first indicators are located at substantially equal rotational intervals.

5. A coaxial connector as defined in claim 1, further comprising:

a plurality of the second indicators located at rotational intervals associated with the second coaxial connector part.

6. A coaxial connector as defined in claim 5, wherein:

the plurality of second indicators are located at substantially equal rotational intervals.

7. A coaxial connector as defined in claim 1, further comprising:

a plurality of the first indicators located at substantially equidistant rotational intervals associated with the nut;

a plurality of the second indicators located at substantially equidistant rotational intervals associated with the second connector part; and the equidistant rotational intervals separating the first indicators are substantially the same equidistant rotational intervals separating the second indicators.

8. In a coaxial connector for connecting a coaxial cable to a terminal adapter comprising a first coaxial connector part having threads, a second coaxial connector part having threads which mate with the threads of the first connector part, one of the first or second connector parts connected to the coaxial cable and the other one of the first or second connector parts connected to the terminal adapter; and an improvement comprising:

a plurality of first indicators spaced around the first coaxial connector part to indicate the relative position of the first connector part upon threading the first and second connector parts together;

a plurality of second indicators spaced around the second coaxial connector part to indicate the relative position of the second connector part upon threading the first and second connector parts together; and information associated with at least one of the first and second connector parts which correlates an amount of relative movement of the first and second indicators to establish a predetermined torque to connect the first and second connector parts.

9. A coaxial connector as defined in claim 8, wherein:

at least one of the plurality of first and second indicators is attached to one of the respective first and second coaxial connector parts.

10. A coaxial connector as defined in claim 8, wherein:

at least one of the plurality of first and second indicators is attached to the terminal adapter.

11. A coaxial connector as defined in claim 8, wherein:

the one of the first or second coaxial connector parts connected to the coaxial cable includes a body which is stationarily positioned relative to the coaxial cable; and at least one of the plurality of first or second indicators of the one connector part connected to the coaxial cable is attached to the body.

12. A coaxial connector as defined in claim 8, wherein:

the plurality of first indicators are rotationally spaced around the first connector part at substantially equidistant intervals; and the plurality of second indicators are rotationally spaced around the second connector part at substantially equidistant intervals.

13. A coaxial connector as defined in claim 12, wherein:

the equidistant intervals at which the plurality of first indicators are rotationally spaced around the first connector part are substantially the same as the equidistant intervals at which the plurality of second indicators are rotationally spaced around the second connector part.

14. A coaxial connector as defined in claim 8, wherein:

the first coaxial connector part comprises a nut with a threaded interior; and the second coaxial connector part comprises a post with a threaded exterior.

15. A coaxial connector as defined in claim 14, wherein:

the plurality of first indicators are rotationally spaced around the nut; and the plurality of second indicators are rotationally spaced around the post.

16. A method of tightening a two-part, rotationally-connectable coaxial connector to a recommended predetermined amount of torque without measuring torque, comprising:

using a first part of the coaxial connector which has a rotatable internally threaded nut and at least one first indication on the nut;

using a second part of the coaxial connector which has a stationary externally threaded post and at least one second indication relative to the post;

threading the nut onto the post by rotating the nut relative to the post to a first predetermined position from which to start using the movement of the first indicator relative to the second indicator to establish the predetermined amount of torque;

using a wrench to continue threading the nut onto the post from the first predetermined position until the predetermined amount of torque between the nut and the post is established; and using the movement of the first indicator relative to the second indicator to establish the predetermined amount of torque.

17. A method as defined in claim 16, further comprising:

using fingers to thread the nut onto the post to the first predetermined position from which to start using the movement of the first indicator relative to the second indicator to establish the predetermined amount of torque.

18. A method as defined in claim 17, further comprising:

using fingers to thread the nut onto the post to a finger tight position to establish the first predetermined position.

19. A method as defined in claim 16, further comprising:

counting movement transitions between the first and second indicators from the first predetermined position to establish the predetermined amount of torque.

20. A method as defined in claim 16, further comprising:

correlating the number of movement transitions between the first and second indicators from the first predetermined position to establish the predetermined amount of torque.

* * * * *